US008950310B2

(12) United States Patent
Storrs et al.

(10) Patent No.: US 8,950,310 B2
(45) Date of Patent: Feb. 10, 2015

(54) FIREARM SUPPRESSOR AND INJECTOR ASSEMBLY

(71) Applicant: Storrs Investments, L.L.C., Provo, UT (US)

(72) Inventors: Norven Storrs, Springville, UT (US); Jarod Todd, Provo, UT (US)

(73) Assignee: Storrs Investments, L.L.C., Provo, UT (US)

( * ) Notice: Subject to any disclaimer, the term of this patent is extended or adjusted under 35 U.S.C. 154(b) by 0 days.

(21) Appl. No.: 13/900,497

(22) Filed: May 22, 2013

(65) Prior Publication Data

US 2013/0312592 A1 Nov. 28, 2013

Related U.S. Application Data

(60) Provisional application No. 61/650,383, filed on May 22, 2012.

(51) Int. Cl.
*F41A 21/30* (2006.01)
*F01N 3/02* (2006.01)

(52) U.S. Cl.
CPC .. *F01N 3/02* (2013.01); *F41A 21/30* (2013.01)
USPC ..... 89/14.1; 181/223

(58) Field of Classification Search
CPC ..... F41A 21/36; F41A 21/34; F41A 21/30
USPC ..... 89/14.1, 14.2, 14.3, 14.4; 181/223
See application file for complete search history.

(56) References Cited

U.S. PATENT DOCUMENTS

| | | | | |
|---|---|---|---|---|
| 2,503,491 | A * | 4/1950 | Janz | 181/223 |
| 5,136,923 | A * | 8/1992 | Walsh, Jr. | 89/14.2 |
| 7,207,255 | B2 * | 4/2007 | Felton et al. | 89/14.3 |
| 7,874,238 | B2 * | 1/2011 | Silvers | 89/14.4 |
| 8,511,425 | B2 * | 8/2013 | Larue | 181/223 |

* cited by examiner

*Primary Examiner* — Reginald Tillman, Jr.
(74) *Attorney, Agent, or Firm* — Sunstone IP

(57) ABSTRACT

A suppressor assembly for connection to the muzzle of a firearm includes an injector portion for connection to the muzzle and a suppressor portion for connection to the injector portion. The injector portion has a chamber for holding a quantity of fluid. When a firearm is discharged and the projectile passes through the injector portion, fluid is drawn from the chamber and into the suppressor portion to thereby shield the suppressor portion from full impact of gases associated with the fired projectile. The injector and suppressor portions can be operated independently and the injector portion can also function as a muzzle break, flash suppressor, and so on.

17 Claims, 4 Drawing Sheets

FIREARM SUPPRESSOR AND INJECTOR ASSEMBLY

CROSS-REFERENCE TO RELATED APPLICATIONS

This application claims the benefit of U.S. Provisional Application No. 61/650,383 filed on May 22, 2013, the disclosure of which is hereby incorporated by reference.

FIELD OF THE INVENTION

This invention relates to firearm accessories, and more particularly to a sound suppressor or silencer, as well as an injector assembly connectable between the suppressor and firearm.

BACKGROUND OF THE INVENTION

Suppressors for firearms, also known as silencers, generally operate to reduce the audible noise or sharp report of a firing weapon by means of reducing and controlling the energy level of attendant propellant gases. Generally, the techniques include the provision of a series of baffles which control and delay the flow, expansion, and discharge of propellant gases, forcing the propellant gases to pass through various temperature absorbent materials, or a combination of these or functionally similar techniques to reduce the temperature and abrupt discharge of propellant gases. The result achieved is a corresponding reduction in the noise produced by the discharging propellant gases.

Known silencers for firearms can be generally classified into two groups. In one group, the discharge and propellant gases that follow the bullet into the silencer are stored for a short period of time in a plurality of successive chambers which are closed to the outside environment. This produces a controlled expansion of the propellant gases through each chamber, thereby reducing their temperature and pressure. In a second group, at least a portion of the propellant gases are diverted to exterior coaxial chambers through a plurality of passages between inner and outer walls. Although such arrangements are more complex, they can provide more capacity to delay and cool the gases, and hence reduce the muzzle sound level.

The generic silencer baffle, used in the first group of silencers, typically is in the form of a flat disk with a cut-out for a bullet passage. More complex baffles include cone or funnel shapes, such as well-known K or M baffles. Another type of baffle is an elliptically-shaped flat baffle placed within the silencer body at an angle. Slanted or asymmetric baffles have also been in use wherein adjacent flat baffles are tilted in opposite directions with respect to the longitudinal axis of the silencer.

Sometimes silencers of any baffle style are combined with heat absorbing mesh or metallic pellets which must be replaced as they become clogged or worn out. To keep propellant gases from escaping with the bullet, some solutions employ wipes which are generally elastomer disks with an 'X' cut in the center to allow the bullet to pass. However, such structures wear out quickly, resulting in a service life of well under 100 shots.

No matter what the type of baffle is used in the suppressor, it often becomes difficult to remove from the suppressor housing for cleaning, as tough residue from the discharge gases can build up quickly in and around crevices, creating a bond between the suppressor components which can be difficult to break. Moreover, baffles closer to the muzzle end of the firearm are subjected to greater pressure, contaminants, heat from the firearm flash during discharge, etc., than baffles located further away from the muzzle end, thereby causing premature wear and failure of the suppressor.

It would therefore be desirous to overcome advantages of prior art arrangements for suppressing or hiding firearm flash and/or noise during firearm discharge.

SUMMARY OF THE INVENTION

In accordance with one aspect of the invention, a suppressor assembly for connection to the muzzle of a firearm includes an injector portion adapted for connection to the muzzle, the injector portion having a chamber for holding a quantity of fluid; and a suppressor portion connectable to the injector portion, the suppressor portion being in fluid communication with the injector portion. With this arrangement, fluid is drawn from the chamber and into the suppressor portion when a fired projectile passes therethrough to thereby shield the suppressor portion from full impact of gases associated with the fired projectile.

In accordance with a further aspect of the invention, an injector assembly for connection to the muzzle of a firearm includes an outer injector cover; a core portion; a distal end wall located at one end of the core portion; a proximal end wall located at an opposite end of the core portion; a central bore extending through the core portion, the central bore being sized for receiving a projectile upon discharge of the firearm; the chamber being formed between the outer cover, the core portion, and the distal and proximal end walls for receiving a quantity of fluid; and at least one aperture extending between the chamber and the central bore for fluidly connecting the central bore and the chamber. In this manner, the discharged projectile passing through the central bore of the core portion and across the at least one aperture creates a vacuum in the chamber to thereby draw fluid from the chamber and into the central bore to thereby lubricate and cool the injector assembly.

BRIEF DESCRIPTION OF THE DRAWINGS

The following detailed description of the preferred embodiments of the present invention will be best understood when considered in conjunction with the accompanying drawings, wherein like designations denote like elements throughout the drawings, and wherein.

and

Figure 6:
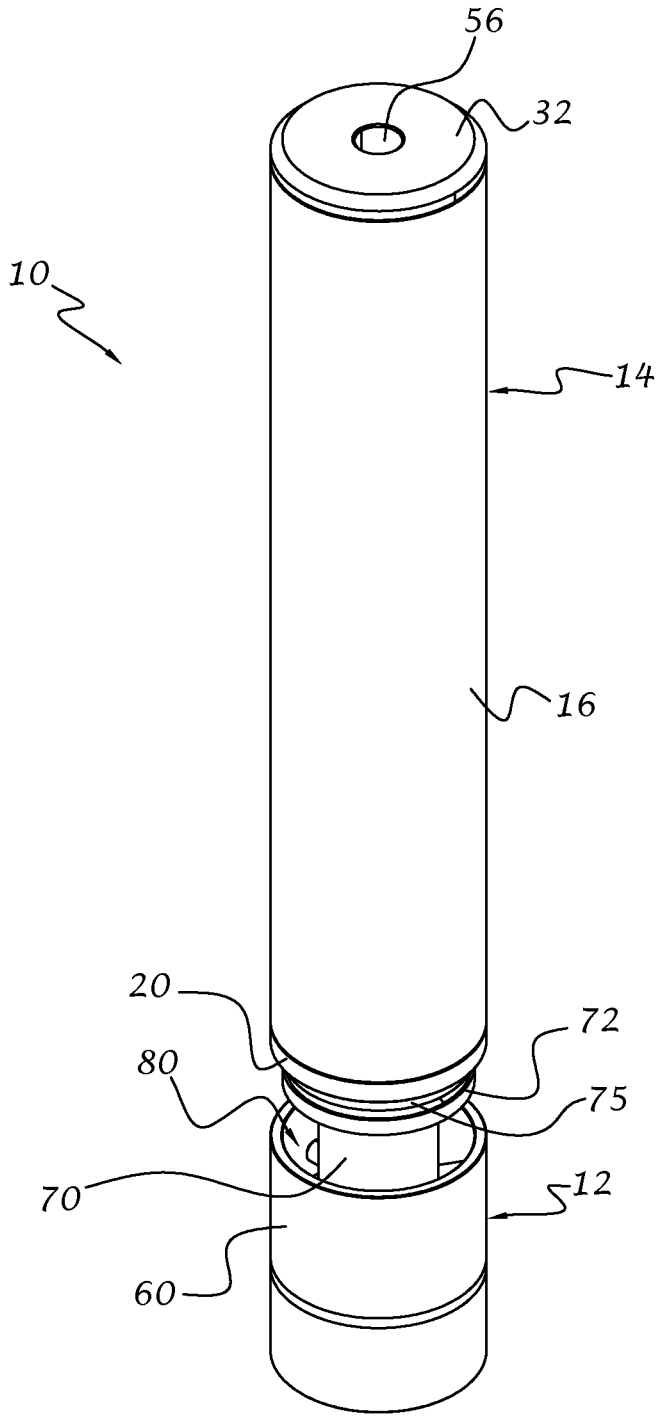

FIG. 6 a front isometric view of the firearm suppressor assembly showing a partially exposed lubricant chamber for filling the chamber with fluid.

It is noted that the drawings are intended to depict exemplary embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
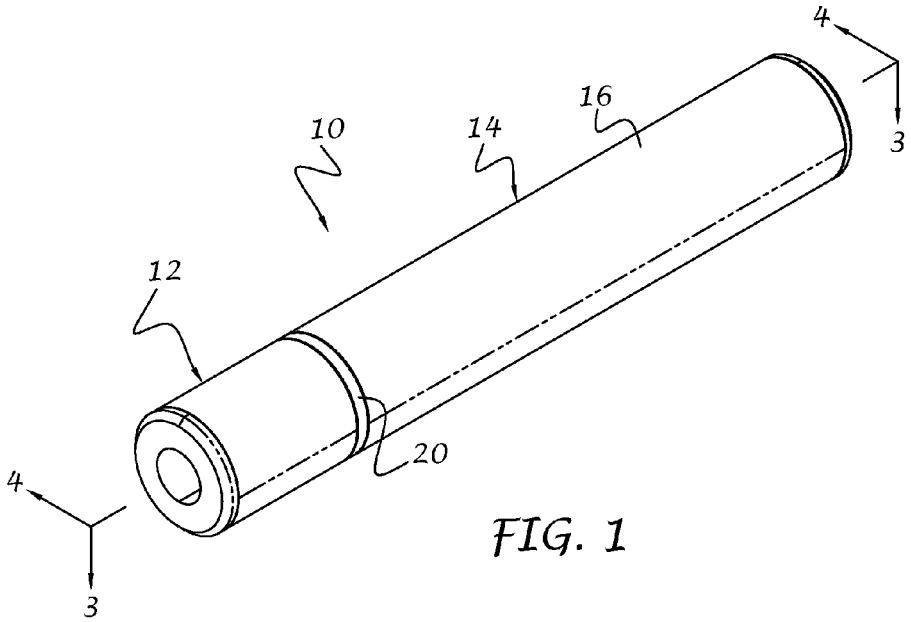
FIG. 1 is a rear isometric view of a firearm suppressor assembly in accordance with the present invention.
Figure 2:
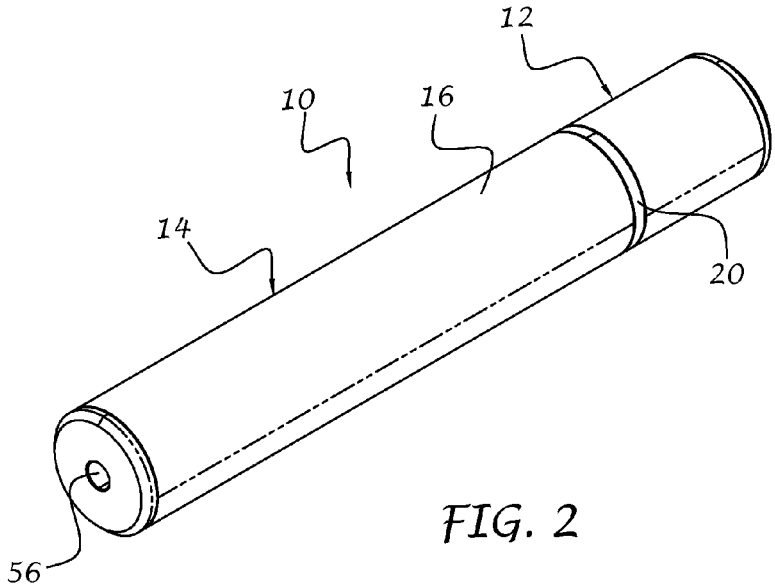
FIG. 2 is a front isometric view thereof.

Referring to the drawings, and to FIGS. 1 and 2 in particular, a firearm suppressor assembly 10 in accordance with one embodiment of the present invention is illustrated. The suppressor assembly 10 is adapted for coupling to the muzzle of a firearm (not shown). The suppressor assembly 10 can be adapted for practically any type of firearm, including but not limited to, large and small caliber rifles, handguns, single-shot, semi-automatic and fully automatic guns, bolt-action rifles, shotguns, rim-fire and center-fire guns, and so on. The suppressor assembly 10 preferably includes an injector portion 12 connected to a suppressor portion 14. The injector portion 12 serves to enhance the muffling effect of the suppressor portion 14 and can also serve as a flash suppressor, muzzle break, or other adapter, although a separate flash suppressor, etc. (not shown) can also be used. In addition, although the injector portion 12 and suppressor portion 14 are shown as separate units, it will be understood that they can be integrally formed as a single unit without departing from the spirit and scope of the invention.

Figure 3:
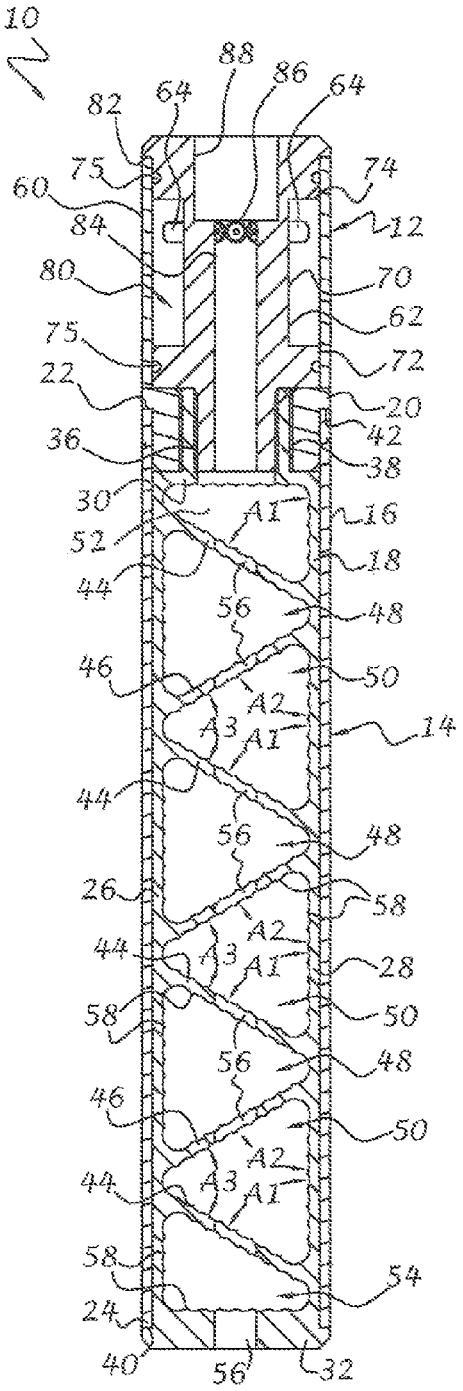
FIG. 3 is a side sectional view thereof taken along line 3-3 of FIG. 1.
Figure 4:
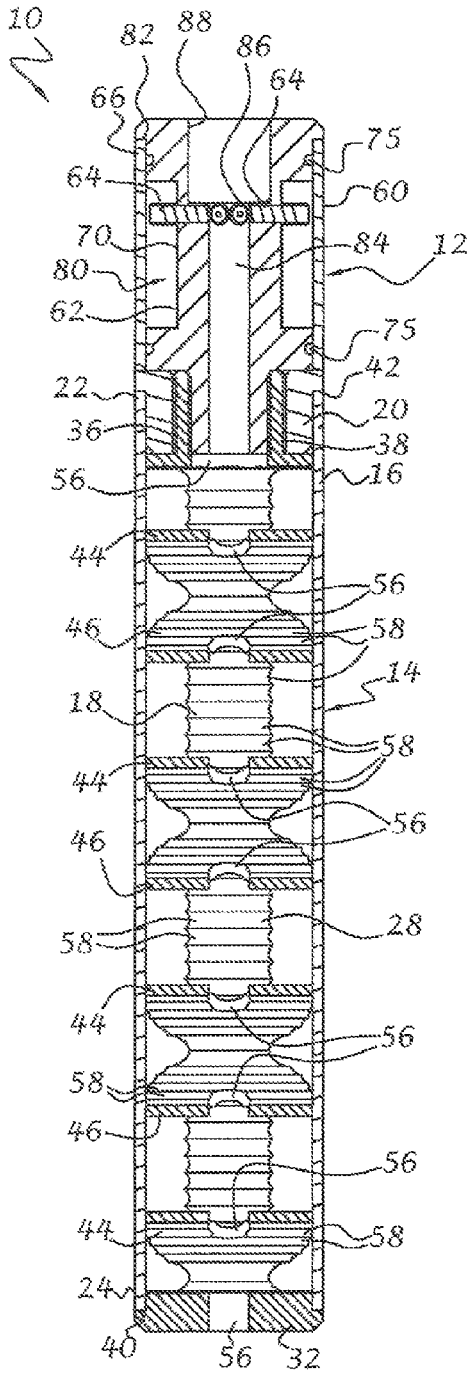
FIG. 4 is a top sectional view thereof taken along line 4-4 of FIG. 1.
Figure 5:
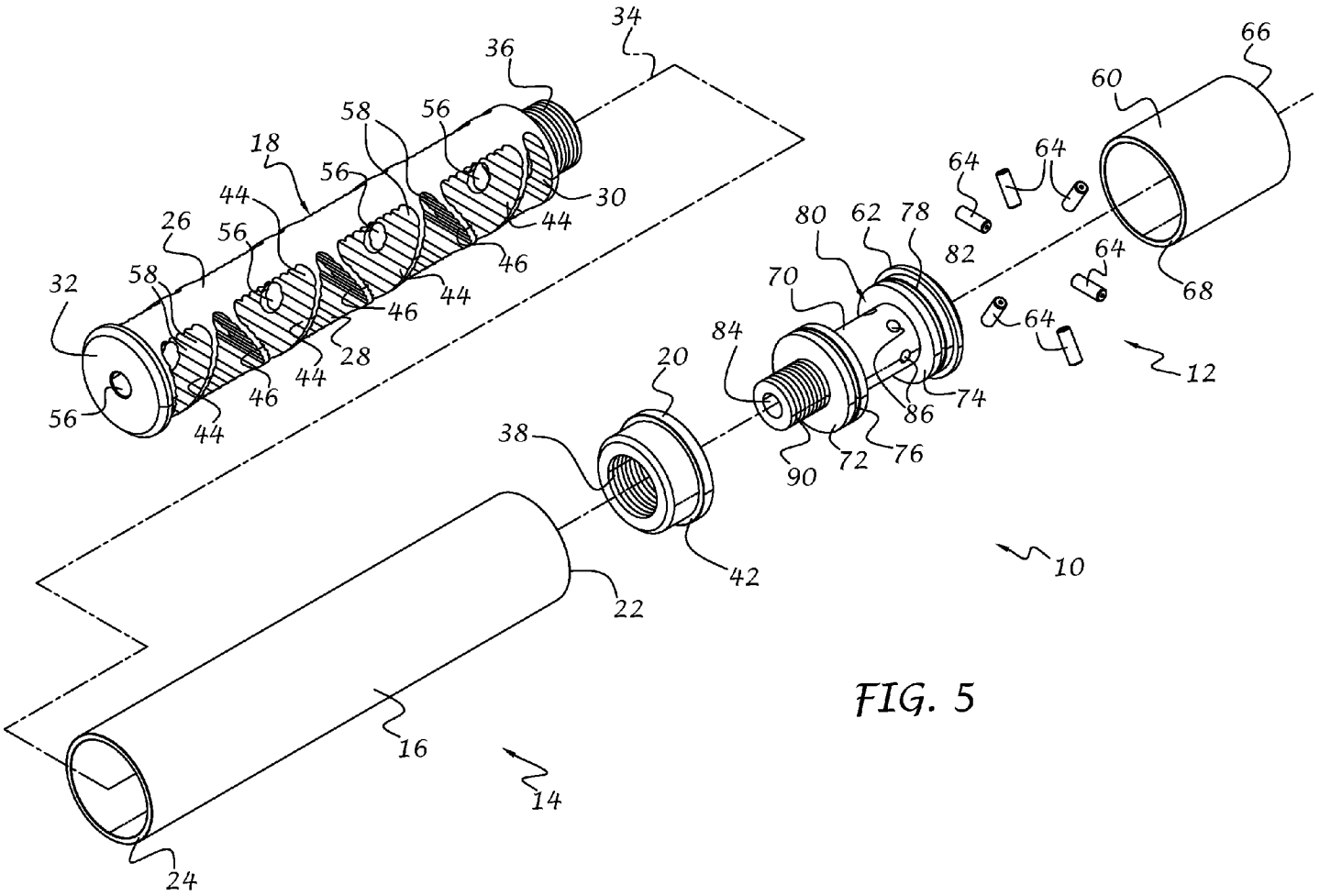
FIG. 5 is a front isometric exploded view of the firearm suppressor assembly.

With additional reference to FIGS. 3-5, the suppressor portion 14 preferably includes an outer cover 16, a suppressor core 18 located within the outer cover, and an end cap 20 for securing the suppressor core 18 within the outer cover.

The outer cover 16 is preferably of a single tubular construction with a continuous side wall having a proximal end 22 adjacent to the injector portion 12 and a distal end 24. For purposes of this description, the term "proximal" refers to a position near the firearm when the suppressor assembly 10 is connected thereto, while the term "distal" refers to a position forward of the proximal position, e.g. closer to an intended target when aiming. The outer cover 16 is preferably constructed of a rugged, lightweight material such as steel, titanium, aluminum, ceramic, composites such as carbon fiber, graphite, and so on.

The suppressor core 18 is preferably of single-piece construction and is constructed of a rugged, lightweight material such as steel, titanium, aluminum, ceramic, composites, and so on. The suppressor core 18 preferably includes an upper wall 26 and a lower wall 28 that extend between a proximal end wall 30 and a distal end wall 32. The terms "upper" and "lower" as used herein are intended to represent relative positions or orientations rather than absolute, since the upper and lower walls may be oriented at any rotational position with respect to the central longitudinal axis 34 (FIG. 5) of the suppressor assembly 10. The upper and lower walls 26, 28 are preferably curved with a radius coincident with the axis 34 so that the suppressor core 18 fits snugly within the outer cover 16. An annular projection 36 preferably extends rearwardly from the proximal end wall 30 and includes outer threads for mating with an internally threaded surface 38 of the end cap 20 to secure the suppressor core 18 centrally within the outer cover 16. The distal end wall 32 preferably includes an inner shoulder 40 that receives the distal end 24 of the outer cover 16 when the suppressor core 18 is installed in the outer cover. When the end cap 20 is threaded onto the annular projection 36, the inner shoulder 40 is pressed against the distal end 24 of the outer cover 16. Likewise, an inner shoulder 42 of the end cap 20 is pressed against the proximal end 22 of the outer cover to sandwich the outer cover between the distal end wall 32 and the end cap 20, thereby centering the suppressor core 18 in the outer cover 16.

Although not shown, the end cap 20 can have diametrically opposed apertures for receiving a bifurcated tool (not shown) to facilitate removal of the end cap and thus the suppressor core 18 when hand removal may be too difficult for some users.

As best shown in FIG. 3, a plurality of first baffles 44 extend at a first acute angle A1 with respect to the upper wall 26 and lower wall 28. Likewise, a plurality of second baffles 46 extend at a second acute angle A2 with respect to the upper and lower walls. Each first baffle 44 also preferably extends at an acute angle A3 with respect to a corresponding second baffle 46. Preferably, the first and second acute angles are equal. In accordance with one embodiment of the invention, the first and second acute angles are in a range of between 50 and 80 degrees and more preferably about 60 degrees. Likewise, the third acute angle is in a range of between 80 and 20 degrees, and more preferably about 60 degrees. The first baffles 44 together with the second baffles 46 and the upper wall 26 and lower wall 28 form alternating expansion chambers 48, 50 that permit expansion of the gases formed under high pressure when ammunition (not shown) associated with the firearm (not shown) is discharged.

An entrance expansion chamber 52 is also formed between the proximal end wall 30 and a first baffle 44. Likewise, an exit expansion chamber 54 is also formed between the distal end wall 32 and a last baffle 44. It will be understood that more or less baffles can be used and that the size of the baffles (and thus the size of the walls and outer cover, including their diameter or cross-dimension and length) can be increased or decreased without departing from the spirit and scope of the invention.

As best shown in FIG. 4, axially aligned openings 56 extend through each baffle and end wall. Each opening is of sufficient diameter or cross dimension to accommodate a particular caliber or range of calibers of a bullet or other projectile associated with the firearm. Transverse grooves 58 are preferably formed on each side of each baffle 44, 46, as well as on one side of the end walls 30, 32, and upper and lower walls 26, 28. The grooves 58 help to increase turbulence of the expanded hot gases as well as increase the available surface area for cooling the gases, and thus can be used with great efficiency on automatic and semi-automatic firearms without overheating. Surprisingly, it has been found that the combination of the particular angles of the baffles, the shapes of the alternating expansion chambers, and the grooved surfaces, significantly reduce the noise and heat generated by fired ammunition to a much greater capacity than prior art solutions.

As best shown in FIGS. 3-5, the injector portion 12 preferably includes an outer cover 60, an injector core 62 located within the outer cover 60, and injector tubes 64 extending into the injector core.

The outer cover 60 is preferably of a single tubular construction with a continuous side wall having a proximal end 66 and a distal end 68 adjacent to the suppressor portion 14. The outer cover 60 is preferably of the same diameter of the outer cover 16 of the suppressor portion 14 and constructed of a rugged, lightweight material such as steel, titanium, aluminum, ceramic, composites such as carbon fiber, graphite, and so on.

The injector core 62 is also preferably constructed of a rugged, lightweight material such as steel, titanium, aluminum, ceramic, composites, and so on. The injector core 62 is preferably generally spool-shaped with a cylindrical core portion 70, a distal end wall 72, and a proximal end wall 74 located at the ends of the core portion 70. The distal end wall 72 is of greater diameter than the core portion 70 and preferably includes a groove 76 for receiving an O-ring 75 to thereby seal the distal end wall 72 against the outer cover 60. Likewise, the proximal end wall 74 is of greater diameter than the core portion 70 and preferably includes a groove 78 for receiving an O-ring 75 to thereby seal the proximal end wall 74 against the outer cover 60. With this arrangement, a chamber 80 is formed between the end walls 72, 74 and the outer cover 60 that can be filled with lubricating fluid, water, or other liquids. An inner shoulder 82 is formed on the proximal end wall 74 to receive the proximal end 66 of the outer cover 60.

A central bore 84 extends through the injector core 62 and is sized for receiving a bullet or other projectile of a particular caliber or range of calibers. Preferably, the diameter or cross dimension of the central bore 84 is equal to the diameter or cross dimension of the openings 56 associated with the baffles 44, 46. Apertures 86 preferably extend radially through the core portion 70 and intersect with the central bore 84 so that the chamber 80 is in fluid communication with the central bore. An injector tube is located in each bore and extends radially outwardly into the chamber at a position proximal to the outer cover 60. In this manner, liquid in the chamber 80 can be accessed at a low fill level and at any angle about the central axis during use. It will be understood that more or less apertures and injector tubes can be provided without departing from the spirit and scope of the invention.

An enlarged bore 88 is formed in the proximal end wall 74 and may be equipped with threads or other well-known attachment means for connecting the injector portion 12 to the muzzle of a firearm. A threaded projection 90 preferably extends forwardly from the distal end wall 72 and mates with internal threads of the annular projection 36 of the suppressor core 18 to connect the injector portion 12 to the suppressor portion 14.

In use, as a bullet or other projectile passes through the bore 84 of the injector core 62 and across the radially extending apertures 86, a vacuum is created in the chamber 80, thereby drawing liquid from the chamber 80 and into the bore 84. The liquid not only serves to lubricate and cool the various internal components of the firearm suppressor assembly 10, but, surprisingly, also increases its capacity to suppress the sound of the expanding gases during firing of the ammunition. This capacity is renewed each time a bullet or other projectile passes through the injector portion 12. In addition, since the projectile must first pass through the injector core 52 prior to the suppressor portion 14, the proximal baffle 44 is shielded from the full impact of the discharge or propellant gases. The injector portion thus significantly reduces the initial muzzle pressure, slows and cools gases, and allows the suppressor to be much more effective and efficient at reducing the flash and noise exiting the end of the suppressor. Accordingly, the provision of an injector portion 12 preserves the useful life of the suppressor portion 14 and greatly enhances the suppression effect of the suppressor portion.

Referring now to FIG. 6, the chamber 80 can be accessed for filling or refilling by adjusting the outer cover 60 of the injector portion 12 to an open position. A user can then fill the chamber 80 with the appropriate liquid then close the chamber by adjusting the outer cover 60 to the closed position. It will be understood that other means for filling the chamber 80 with the cover 60 in the closed position can be employed without departing from the spirit and scope of the invention.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. By way of example, means for connecting the firearm muzzle to the injector portion, the means for connecting the injector portion to the suppressor portion, as well as the means for forming and connecting internal components can be accomplished through any well-known connection means such as welding, adhesive bonding, press-fitting, integral molding and/or forming, and so on. Moreover, it will be understood that the suppressor portion can be used independently of the injector portion and vice-versa. It will be understood, therefore, that this invention is not limited to the particular embodiments disclosed, but also covers modifications within the spirit and scope of the present invention as defined by the appended claims.

We claim:

1. A suppressor assembly for connection to the muzzle of a firearm, the suppressor assembly comprising:

a) an injector portion adapted for connection to the muzzle, the injector portion having a chamber for holding a quantity of fluid; and b) a suppressor portion connectable to the injector portion, the suppressor portion being in fluid communication with the injector portion, wherein the suppressor portion comprises a suppressor core of a single-piece construction, wherein the suppressor core comprises a. an upper wall;

b. a lower wall;

c. at least one first baffle extending at a first acute angle with respect to the upper and lower walls; and d. at least one second baffle extending at a second acute angle with respect to the upper and lower walls; and c) a plurality of transverse grooves formed on each side of the at least one first baffle and the at least one second baffle and the upper and lower walls;

d) wherein fluid is drawn from the chamber and into the suppressor portion when a fired projectile passes therethrough to thereby shield the suppressor portion from full impact of gases associated with the fired projectile.

2. A suppressor assembly according to claim 1, wherein the injector portion comprises:

a) an outer injector cover;

b) a core portion;

c) a distal end wall located at one end of the core portion;

d) a proximal end wall located at an opposite end of the core portion;

e) a central bore extending through the core portion, the central bore being sized for receiving a projectile associated with a firearm;

f) the chamber being formed between the outer cover, the core portion, and the distal and proximal end walls for receiving a quantity of fluid; and g) at least one aperture extending through the core portion for fluidly connecting the central bore and the chamber;

h) wherein the fired projectile passing through the central bore of the core portion and across the at least one aperture creates a vacuum in the chamber to thereby draw fluid from the chamber into the central bore and into the suppressor portion to thereby lubricate and cool the suppressor portion and increase its suppressive capacity.

3. A suppressor assembly according to claim 2, wherein the at least one aperture comprises a plurality of apertures extending through the core portion.

4. A suppressor assembly according to claim 3, wherein the core portion is cylindrical in shape and the apertures extend radially through the core portion.

5. A suppressor assembly according to claim 4, and further comprising a plurality of injector tubes extending radially from the plurality of apertures and terminating proximal to the outer cover so that fluid in the chamber proximal to the outer cover can be drawn into the central bore, even at a low fluid level condition and at substantially any angle about a central axis of the central bore during use.

6. A suppressor assembly according to claim 2, wherein the distal and proximal end walls are sealed to the outer cover.

7. A suppressor assembly according to claim 6, wherein the outer cover is at least partially removable from the core portion to enable filling the chamber with fluid.

8. A suppressor assembly according to claim 2, wherein the core portion is cylindrical in shape and the at least one aperture extends radially through the core portion.

9. A suppressor assembly according to claim 8, for connection to the muzzle of a firearm, the supporessor assembly comprising:

an injector portion adapted for connection to the muzzle, the injector portion having a chamber for holding a quantity of fluid; and a suppressor portion connectable to the injector portion, the suppressor portion being in fluid communication with the injector portion;

wherein fluid is drawn from the chamber and into the suppressor portion when a fired projectile passes therethrough to thereby shield the suppressor portion from full impact of gases associated with the fired projectile;

wherein the injector portion comprises:

an outer injector cover;

a core portion;

a distal end wall located at one end of the core portion;

a proximal end wall located at an opposite end of the core portion;

a central bore extending through the core portion, the central bore being sized for receiving a projectile associated with a firearm;

the chamber being formed between the outer cover, the core portion, and a distal and proximal end walls for receiving a quantity of fluid; and at least one aperture extending through the core portion for fluidly connecting the central bore and the chamber;

wherein the fired projectile passing through the central bore of the core portion and across the at least one aperture creates a vacuum in the chamber to thereby draw fluid from the chamber into the central bore and into the suppressor portion to thereby lubricate and cool the suppressor portion and increase its suppressive capacity, and wherein the core portion is cylindrical in shape and the at least one aperture extends radially through the core portion; and further comprising at least one injector tube extending radially from the at least one aperture and terminating proximal to the outer cover so that fluid in the chamber proximal to the outer cover can be drawn into the central bore, even at a low fluid level condition.

10. A suppressor assembly according to claim 1, wherein the quantity of fluid comprises at least one of a lubricating fluid and a cooling fluid.

11. A suppressor assembly according to claim 1, wherein the suppressor portion comprises:

a) an outer suppressor cover;

b) the suppressor core being located within the outer suppressor cover; and c) an end cap connected to the outer suppressor cover for securing the suppressor core within the outer suppressor cover.

12. A suppressor assembly according to claim 11, wherein the suppressor core further comprises:

a) a plurality of first baffles extend at a first acute angle with respect to the upper and lower walls, wherein the at least one first baffle is one of the plurality of first baffles;

b) a plurality of second baffles extend at a second acute angle with respect to the upper and lower walls, wherein the at least one second baffle is one of the plurality of second baffles; and c) each first baffle extending at a third acute angle with respect to a corresponding second baffle;

d) wherein the first baffles together with the second baffles and the upper wall and lower wall forming alternating expansion chambers that permit expansion of gases formed under high pressure when the projectile is fired.

13. A suppressor assembly according to claim 12, wherein the first and second acute angles are substantially equal.

14. A suppressor assembly according to claim 13, wherein the third acute angle is approximately equal to the first and second acute angles.

15. A suppressor assembly according to claim 14, wherein the plurality of transverse grooves increase turbulence of expanded hot gases as well as increase the available surface area for cooling the gases.

16. An injector assembly for connection to the muzzle of a firearm, the injector assembly comprising:

a) an outer injector cover;

b) a core portion;

c) a distal end wall located at one end of the core portion;

d) a proximal end wall located at an opposite end of the core portion;

e) a central bore extending through the core portion, the central bore being sized for receiving a projectile upon discharge of the firearm;

f) a chamber being formed between the outer cover, the core portion, and the distal and proximal end walls for receiving a quantity of fluid;

g) at least one aperture extending between the chamber and the central bore for fluidly connecting the central bore and the chamber, wherein the at least one aperture comprises a plurality of apertures extending through the core portion;

h) wherein the discharged projectile passing through the central bore of the core portion and across the at least one aperture creates a vacuum in the chamber to thereby draw fluid from the chamber and into the central bore to thereby lubricate and cool the injector assembly;

i) wherein the core portion is cylindrical in shape and the apertures extend radially through the core portion; and j) further comprising a plurality of injector tubes extending radially from the plurality of apertures and terminating proximal to the outer cover so that fluid in the chamber proximal to the outer cover can be drawn into the central bore, even at a low fluid level condition and at substantially any angle about a central axis of the central bore during use.

17. An injector assembly according to claim 16, wherein the fluid comprises at least one of a lubricating fluid and cooling fluid.

* * * * *